US009862528B2

(12) United States Patent
Isogai et al.

(10) Patent No.: US 9,862,528 B2
(45) Date of Patent: Jan. 9, 2018

(54) CAP ASSEMBLY AND METHOD FOR CAPPING SAME

(71) Applicant: TOKAN KOGYO CO., LTD., Tokyo (JP)

(72) Inventors: Takamitsu Isogai, Tokyo (JP); Keita Iwamizu, Tokyo (JP); Takeshi Isobe, Tokyo (JP); Hideyuki Muroi, Tokyo (JP); Souma Takamiya, Tokyo (JP)

(73) Assignee: TOKAN KOGYO CO., LTD., Tokyo (JP)

( * ) Notice: Subject to any disclaimer, the term of this patent is extended or adjusted under 35 U.S.C. 154(b) by 71 days.

(21) Appl. No.: 14/903,628

(22) PCT Filed: Jul. 12, 2013

(86) PCT No.: PCT/JP2013/069168
§ 371 (c)(1),
(2) Date: Jan. 8, 2016

(87) PCT Pub. No.: WO2015/004802
PCT Pub. Date: Jan. 15, 2015

(65) Prior Publication Data

US 2016/0244224 A1 Aug. 25, 2016

(51) Int. Cl.
*B65D 47/36* (2006.01)
*B65D 47/12* (2006.01)
(Continued)

(52) U.S. Cl.
CPC ..... *B65D 47/36* (2013.01); *B65B 7/2835* (2013.01); *B65D 47/106* (2013.01);
(Continued)

(58) Field of Classification Search
CPC .... B65D 47/36; B65D 51/228; B65D 47/121; B65D 47/106; B65D 47/123;
(Continued)

(56) References Cited

U.S. PATENT DOCUMENTS 3,167,202 A * 1/1965 Tolciss ..... B65D 47/123 215/307
4,402,417 A * 9/1983 Corrigan, Jr. ..... B65D 1/0238 215/232
(Continued)

FOREIGN PATENT DOCUMENTS

GB 1143416 A 2/1969
JP 50-140854 U 11/1975
(Continued)

OTHER PUBLICATIONS

International Search Report for PCT/JP2013/069168 dated Oct. 1, 2013.

*Primary Examiner* — James N Smalley
(74) *Attorney, Agent, or Firm* — Sughrue Mion, PLLC

(57) ABSTRACT

The present invention is related to a cap assembly which is put over a mouth of a bottle and a method for capping of capping the cap assembly to a bottle, and includes a function that makes it possible to open an inner stopper only by operating a cap when removing the cap initially, and makes attaching thereof to the bottle easy. There are included an inner stopper 40 and a cap 50, which respectively include a male screw thread 411*c* and a female screw thread 541, and the inner stopper 40 and the cap 50 while a state in which they are assembled is maintained are capped to a bottle 60, and when the cap 50 is removed initially, the cap 50 is firstly rotated in a direction of closing to have a junction section 52 broken, and then the cap 50 is rotated in a direction of opening so that the lid body 42 of the inner stopper 40 is removed together with cap 50, thereby causing the inner stopper 40 also to be in a state of being opened.

4 Claims, 21 Drawing Sheets

(51) Int. Cl.
*B65B 7/28* (2006.01)
*B65D 47/10* (2006.01)
*B65D 51/22* (2006.01)

(52) U.S. Cl.
CPC ..... *B65D 47/121* (2013.01); *B65D 47/123* (2013.01); *B65D 51/228* (2013.01); *B65D 2251/0015* (2013.01); *B65D 2251/0087* (2013.01)

(58) Field of Classification Search
CPC .... B65D 2251/0015; B65D 2251/0087; B65B 7/2835
USPC ..... 215/48, 253; 222/153.07, 544, 547
See application file for complete search history.

(56) References Cited

U.S. PATENT DOCUMENTS 4,434,904 A * 3/1984 D'Amico ..... B65D 55/02 215/232
4,494,663 A * 1/1985 Bertaud ..... B65D 41/3495 215/232
4,526,279 A 7/1985 Weiler et al.
4,662,529 A * 5/1987 Moore ..... B65D 1/0238 215/48
4,721,215 A * 1/1988 Bertaud ..... B65D 1/0238 215/253
4,984,699 A * 1/1991 Zalut ..... B65D 51/18 215/231
5,090,581 A * 2/1992 Rose ..... B65D 51/228 215/253
8,235,232 B2 8/2012 Isogai et al.
8,496,129 B2 7/2013 Isogai et al.
2009/0308834 A1* 12/2009 Isogai ..... B65D 47/0838 215/329

FOREIGN PATENT DOCUMENTS

JP 52-147676 U 11/1977
JP 55-90561 U 6/1980
JP 6-76082 U 10/1994
JP 3003064 U 10/1994
JP 8-318967 A 12/1996
JP 2006-206174 A 8/2006
JP 4581034 B1 11/2010
JP 2011-225220 A 11/2011
JP 2011-235898 A 11/2011
JP 2012-224375 A 11/2012
JP 2013-147264 A 8/2013
JP 2013-147265 A 8/2013
WO 2007/126062 A1 11/2007

* cited by examiner

CAP ASSEMBLY AND METHOD FOR CAPPING SAME

CROSS REFERENCE TO RELATED APPLICATIONS

This application is a National Stage of International Application No. PCT/JP 2013/069168 filed Jul. 12, 2013, the contents of which are incorporated herein by reference in their entirety.

TECHNICAL FIELD

The present invention is related to a cap assembly which is put over a mouth of a bottle, and a method for capping of capping the cap assembly to a bottle.

BACKGROUND ART

Conventionally, there have been used many containers of configuration in which, for example, a mouth of a bottle filled with food having fluidity such as mayonnaise, jam and the like is closed with an inner stopper, a seal and the like, and then a cap is put thereon. In a case of such configuration, in order to take a content from a bottle, operations such as removing a cap at first, and after that, opening a pull-tab of an inner stopper, or removing a seal are required, and so, it is pointed out that it may be difficult for an elderly person to remove the pull-tab, or the content of the bottle may stick to a hand or scatter around when removing the seal, and so on, and thus, the usability is poor.

In order to improve this, in recent years, there has been proposed cap assemblies of configuration in which, when removing a cap initially, by rotating temporarily the cap in a direction opposite to a direction of removing to open an inner stopper and then rotating the cap in the direction of removing, it is possible to remove the cap in a state in which the inner stopper is opened (see, Patent Literatures 1, 2 and 3). According to the cap assemblies of the proposals, it is not required to open the inner stopper after removing the cap, and thus, the usability is much improved.

PRIOR ART LITERATURES

Patent Literatures

Patent Literature 1: International Patent Publication Pamphlet No. WO/2007/126062.

Patent Literature 2: Japanese Laid-Open Patent Literature No. 2011-225220.

Patent Literature 3: Japanese Patent No. 4581034.

ABSTRACT OF THE INVENTION

Technical Problem

In a cap assembly of the above-described proposals, it is required that after a bottle is filled with a contend and capped with an inner stopper, a cap is attached in a process different from that of capping the inner stopper. In addition, in order to prevent the inner stopper from being inadvertently opened before delivered to a consumer, and in order to be make easy opening possible after delivered to a consumer as well, it is required to control an attaching position of a cap in a high precision manner. Such control may be performed easily by a cap assembly manufacture, and however, since attaching a cap is required to be performed after a bottle is filled with a content and capped with an inner stopper, attaching a cap to an inner stopper in a high precision manner is left for not a side of a cap assembly manufacturer but a food manufacture, and thus, resulting in putting a burden of facilities to a food manufacture from a technical viewpoint.

In view of the foregoing, it is an object of the present invention to provide a cap assembly which has a function that make it possible to open an inner stopper only by operating a cap when removing the cap initially, and which is easily attached to a bottle, and a method for capping same.

Solution to Problem

A cap assembly according to the present invention to obtain the above-described objection includes:

an inner stopper that is put over a mouth of a bottle to close the mouth; and a cap that is put over the mouth of the bottle such that the cap covers the inner stopper, wherein the inner stopper includes:

a main body that includes a hollow section which has a hollow shape having an upper opening and a lower opening and being to communicate with the mouth of the bottle, and includes a lower end section to be inserted to the mouth of the bottle, a holding section which holds an upper end section of the bottle in cooperation with the lower end section of the hollow section after the insertion has been executed, and a first screw thread for screwing to the cap; and a lid body that includes a lid section which spreads above the hollow section such that the lid section covers that hollow section, a junction section which is circumferentially junctioned to an upper end edge of the hollow section and closes an opening on an upper end of the hollow section together with the lid section, and that is a component integral with the main body, closes the mouth of the bottle together with the main body, and receives pressing from above to have the junction section broken so as to become a part separate from the main body, the cap includes:

a shell section that is formed to be hollow while opening downward and is put over the mouth of the bottle while covering the inner stopper;

a receiving section that protrudes in a cylindrical shape and downward from an inner side upper surface of the shell section, has a lower opening section, and receives the lid section in an inside to surround an edge of the lid section;

a protrusion section that protrudes inward from an inner circumference surface of the receiving section, interferes with the edge of the lid section to cause the lid section to expand the receiving section when the lid section goes up from below relatively to the cap, causes the receiving section to return to an original shape so as to be positioned below the lid section when the lid section comes to a side of an upper surface of the shell section, and supports the lid section after the junction section is broken; and a second screw thread that is screwed to the first screw thread, and the cap is coupled with the inner stopper in a state in which the first screw thread and the second screw thread are screwed to each other and the cap receives the lid section in the receiving section.

Since the cap assembly according to the present invention is in a state in which the inner stopper and the cap include the above-described respective configurations and are coupled with each other, attaching both of the inner stopper and the cap is completed only by capping the inner stopper which is integrated with the cap to a bottle after filling the bottle with a content in a food manufacturer. Accordingly, it is not required to put a lot of burden of manufacturing facilities to a side of food manufacturer from a technical viewpoint, and in addition, since a number of processes becomes small, cost reduction is expected.

In addition, since the cap assembly according to the present invention is one in which the inner stopper and the cap include the above-described functions, the function that the inner stopper may be opened only by operating the cap when opening the cap initially is maintained as it is.

Here, in the cap assembly according to the present invention, it is preferable that the first screw thread is a screw thread which circles helically on an outer circumference surface of the hollow section, and the cap includes a screwing section which protrudes in a cylindrical shape and downward from the inner side upper surface of the shell section and opens downward, and on whose inner circumference surface a screw thread to be screwed to the male screw thread is formed, and the second screw thread is formed on an inner circumference surface of the screwing section.

The first screw thread and the second screw thread according to the present invention may have such configuration, thereby making it suitable to manufacture the inner stopper and the cap as resin mold components.

In addition, in the cap assembly according to the present invention, it is preferable that the receiving section includes a hook which protrudes inward on a side above the protrusion section on the inner circumference surface of the receiving section and is for preventing a rotation of the cap, the lid section includes plural rotation preventing protrusions which are arranged in a circumferential direction on a circumference surface of the lid section which circumference surface facing the inner circumference surface of the receiving section and engage with the hook, and the cap and the inner stopper are coupled with each other in a state in which the first screw thread and the second screw thread are screwed to each other, the lid section is received in the receiving section, the protrusion section is positioned below the lid section, and the rotation preventing protrusions engage with the hook.

Regardless whether the cap assembly according to the present invention or a cap assembly of conventional type is used, a positional relation between a cap and an inner stopper is fixed by shrink wrap packaging or the like after the cap assembly is attached to a bottle. However, in a case of the cap assembly according to the present invention, the cap and the inner stopper are coupled with each other at a stage before being attached to the bottle. For this reason, if the cap is rotated inadvertently with respect to the inner stopper, the cap may be removed from the inner stopper before being attached to a bottle, or even not removed, the positional relation between the cap and the inner stopper may be changed, and thus, they may not do work properly.

Then, in the cap assembly according to the present invention, the above-described hook and the rotation preventing protrusions which are described above are formed, and the cap and the inner stopper are coupled with each other in a state in which they engage with each other, so that an inadvertent rotation of the cap is prevented without preparing independently a holding member or a package for rotation prevention and the like, and thus, the cap and the inner stopper are maintained to be in a positional relation in which they may make the most of the functions.

Or, in the cap assembly according to the present invention, it is also preferable that the receiving section includes a hook which protrudes inward on a side below the protrusion section on the inner circumference surface of the receiving section and is for preventing rotating of the cap, the lid section includes plural rotation preventing protrusions which are arranged in a circumferential direction on a circumference surface of the lid section which circumference surface facing the inner circumference surface of the receiving section and engage with the hook, and the cap and the inner stopper are coupled with each other in a state in which the first screw thread and the second screw thread are screwed to each other, the lid section is received in the receiving section, the protrusion section is positioned above the lid section, and the rotation preventing protrusions engage with the hook.

Also in this case, similarly to the above cases, an inadvertent rotation of the cap is prevented, and thus, the cap and the inner stopper are maintained to be in a positional relation in which they may make the most of the functions.

In addition, a method for capping of a cap assembly according to the present invention is a method for capping including, with respect to the cap and the inner stopper included in the cap assembly according to the present invention, causing the holding section of the inner stopper to hold an upper end section of the bottle while maintaining a form in which the cap and the inner stopper are coupled with each other in a state in which the first screw thread and the second screw thread are screwed to each other and the lid section is received in the receiving section.

The method for capping of cap assembly according to the present invention is a method in which the capping to a mouth of a bottle is performed while the form in which the cap and the inner stopper are mated with each other is maintained, and thus, at a manufacturing line in which a bottle is filled with a content and then capped, such techniques and facilities that a cap and an inner stopper are couple with each other in a highly precision manner are not required. In addition, since a number of processes may be reduced, the method may lead to cost reduction.

Advantageous Effects of Invention

According to the above described present invention, a cap assembly which has a function that makes it possible to open an inner stopper only by operating a cap when removing the cap initially, and which also is easily attached to a bottle, and a method for capping same are obtained .

BEST MODE FOR CARRYING OUT THE INVENTION

In the following, a comparative example which is compared to the present invention will be explained firstly, and next, embodiments according to the present invention will be explained.

Figure 1:
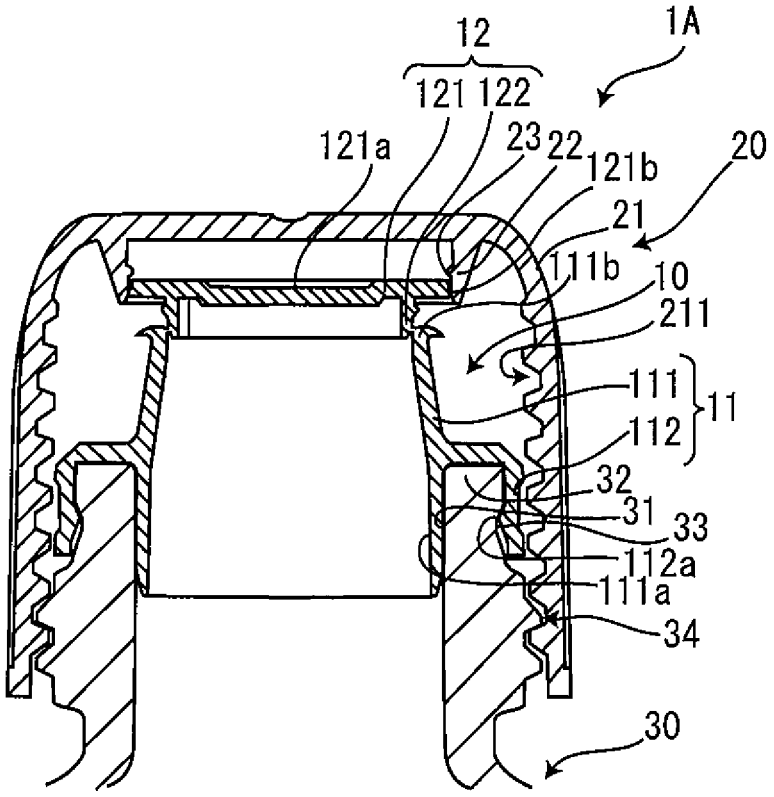
FIG. 1 is a vertical sectional view of a cap assembly of a comparative example.

FIG. 1 is a vertical sectional view of a cap assembly of a comparative example.

A cap assembly 1A of the comparative example illustrated in this FIG. 1 includes a inner stopper 10 and a cap 20.

The inner stopper 10 is a component which is put over a mouth 31 of a bottle 30 to close the mouth 31. In addition, the cap 20 is a component which is put over the mouth 31 of the bottle 30 upon the inner stopper 10 such that the cap 20 covers the inner stopper 10.

This FIG. 1 illustrates a state in which the inner stopper 20 is already capped to the mouth 31 of the bottle 30, the cap 20 is put upon the inner stopper 10 and is in a predetermined relation with respect to the inner stopper 10.

The inner stopper 10 includes a main body 11 and a lid body 12.

The main body 11 includes a hollow section 111 and a holding section 112. Of them, the hollow section 111 has a hollow shape which has an upper opening and a lower opening, and communicates with the mouth 31 of the bottle 30, and a lower end section 111*a* of the hollow section 111 is inserted to the mouth 31 of the bottle 30.

In addition, the holding section 112 included in the main body 11 plays a role of receiving an insertion of an upper end section 32 of the bottle 30 to hold the upper send section 32 of the bottle 30 in cooperation with the lower end section 111*a* of the hollow section 111 which lower end section 111*a* is inserted to the mouth 31 of the bottle 30. The holding section 112 has a configuration in which a rib 112*a* is formed to protrude inward in the holding section 112, and the rib 112*a* enters a depressed section 33 of the bottle 30 so that the holding section 112 firmly holds the upper end section 32 of the bottle 30 and is not removed from the mouth 31 of the bottle 30.

In addition, the lid body 12 included in the inner stopper 10 includes a lid section 121 and a junction section 122. Of them, the lid section 121 is a portion which spreads in a plate shape and above the hollow section 111 such that the lid section 121 covers the hollow section 111. In addition, the junction section 122 is junctioned circumferentially to an upper end edge 111*b* of the hollow section 111, and closes an opening on an upper end of the hollow section 111 together with the lid section 121. The main body 11 and the lid body 12 which are included in the inner stopper 10 are integrally formed as a single component, and however, the junction section 122 is considerably easily broken when the lid section 121 is pressed from above, and when the junction section 122 is broken, the lid body 12 becomes a part separate from the main body 11. This point will be described later.

In order to secure a safety margin ratio as large as possible such that the junction section 122 is not inadvertently broken, it is devised such that a recess 121*a* is formed on an upper surface of the lid section 121 so that the lid section 121 is made to have a shape of being away as much as possible from an upper surface of the cap 20, and even if a force is applied to the upper surface of the cap 20 and the upper surface is depressed, the force is not applied to the lid section 121.

In addition, the cap 20 included in the cap assembly 1A of the comparative example includes a shell section 21, a receiving section 22 and a protrusion section 23.

The shell section 21 is a portion which is formed to be hollow while opening downward, and is put over the mouth 31 of the bottle 30 upon the inner stopper 10 while covering the inner stopper 10. A female screw thread 211 which is screwed to a male screw thread 34 provided in the bottle 30 is formed on an inner circumference surface of the shell section 21, and the cap 20 is rotated to be attached or removed.

In addition, the receiving section 22 is a portion which protrudes in a cylindrical shape and downward from an inner side upper surface of the shell section 22, has a lower opening section, and receives the lid section 121 of the main body 11 in an inside thereof to surround an edge 121*b* of the lid section 121.

Further, the protrusion section 23 is a portion which has a shape of rib protruding inward from an inner circumference surface of the receiving section 22. As described later, the protrusion section 23 protrudes up to a position in which the protrusion section 23 interferes with the edge 121*b* of the lid section 121.

In the case of the cap assembly 1A of the configuration illustrated in this FIG. 1, it is impossible to attach the inner stopper 10 and the cap 20 to the bottle 30 at the same time. In other words, in the case of this cap assembly 1A, after the bottle 30 is filled with a content, the upper send section 32 of the bottle 30 is caused to be held in the holding section 112 of the inner stopper 10. In other words, the inner stopper 10 is capped to the bottle 30. After this capping, the cap is attached such that the cap 20 is put on and rotated, and the protrusion section 23 of the cap 20 is arranged at a position immediately above the lid section 121 of the inner stopper 20 which position is illustrated in FIG. 1. Then, shrink wrap packaging and the like are performed, and the cap 20 becomes a state in which the cap 20 is not inadvertently rotated from the position illustrated in this FIG. 1.

Figure 2:
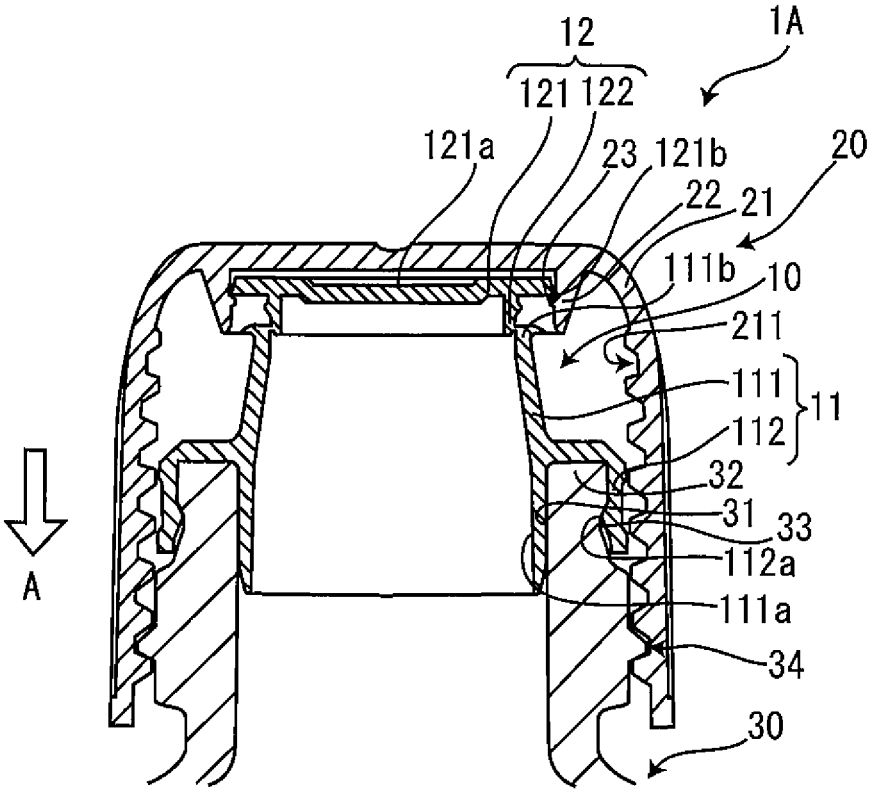
FIG. 2 is a view illustrating behaviors at the time of opening by a consumer as to the comparative example illustrated in FIG. 1.
Figure 3:
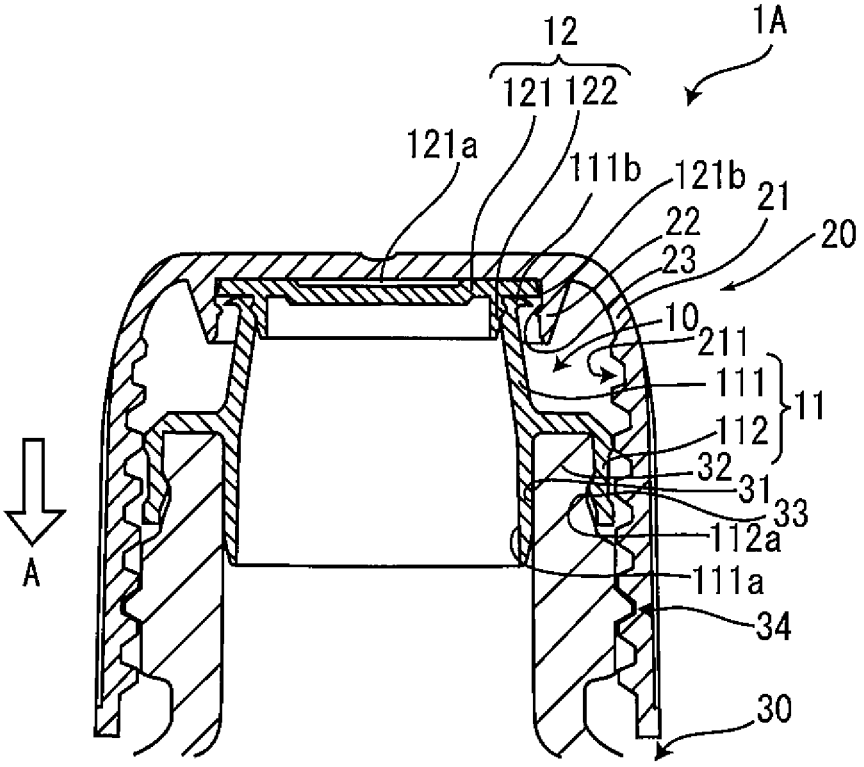
FIG. 3 is a view illustrating behaviors at the time of opening by an user as to the comparative example illustrated in FIG. 1.
Figure 4:
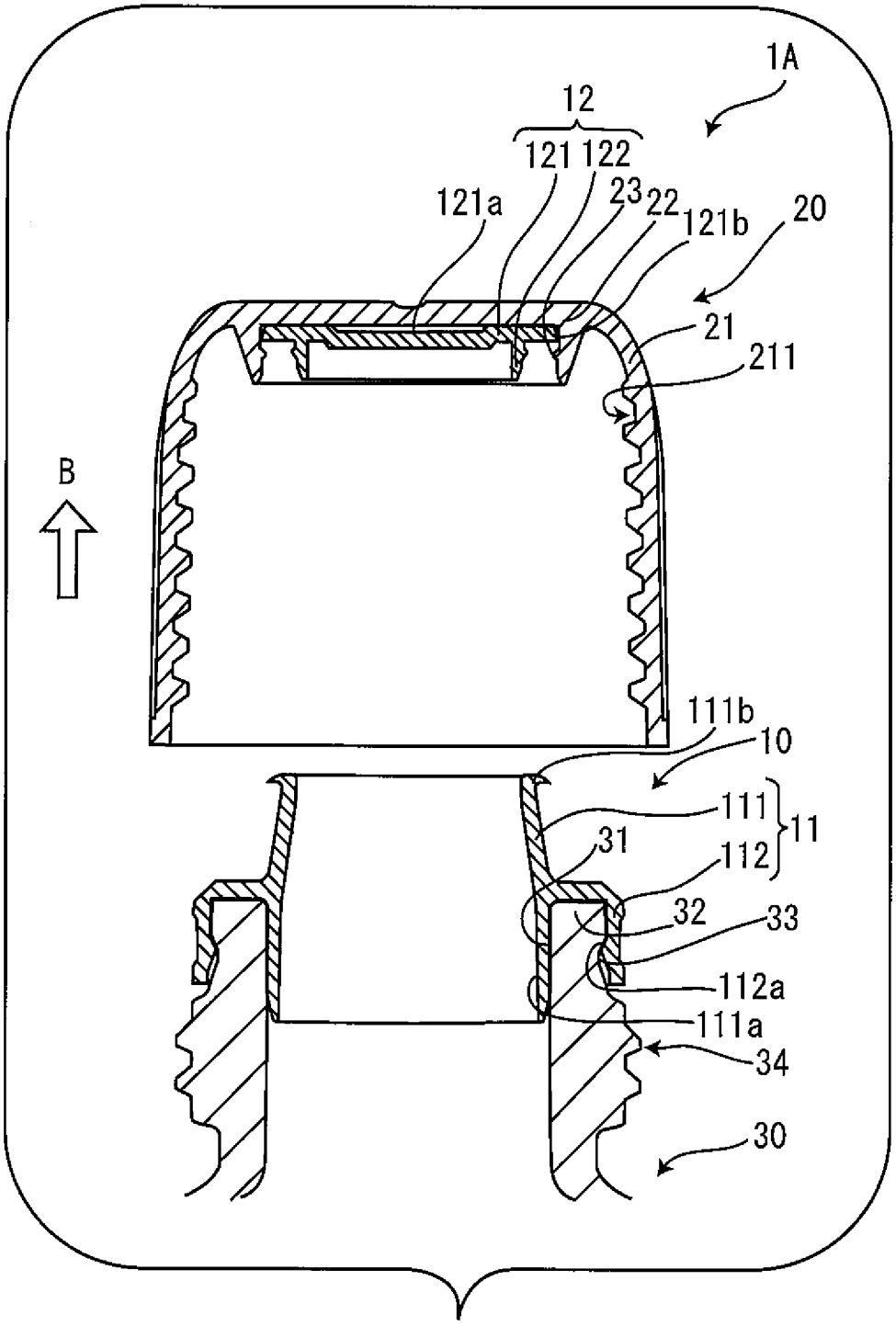
FIG. 4 is a view illustrating behaviors at the time of opening by an user as to the comparative example illustrated in FIG. 1.

FIG. 2 to FIG. 4 are views illustrating behaviors at the time of opening by a consumer as to the comparative example illustrated in FIG. 1

After delivered to a consumer in the state illustrated in FIG. 1, when the consumer is going to open the cap initially, after the consumer removes the shrink wrap at first, the consumer rotates the cap in a direction of closing further. Then, the cap 20 moves in a direction indicated by arrow A illustrated in FIG. 2, and the lid section 121 moves and comes upper than the protrusion section 23 while the edge 121*b* of the lid section 121 of the inner stopper 10 interferes with the protrusion section 23 of the cap 20 to expand the receiving section 22, as illustrated in FIG. 2. Then, the interference between the edge 121*b* of the lid section 121 and the protrusion section 23 of the cap 20 is released and the receiving section 22 returns to its original shape, and the protrusion section 23 of the cap 20 comes below the edge 121*b* of the lid section 121.

When the cap 20 is further rotated in the direction of closing so that the cap 20 is further moved in the direction of arrow A, the cap 20 presses the lid section 121, and the junction section 122 is broken, as illustrated in FIG. 3. When the cap 20 is rotated in the direction of closing and becomes the state illustrated in FIG. 3, the cap 20 becomes not further rotating in the direction of closing, and then, the cap 20 is now rotated in a direction of opening Then, as illustrated in FIG. 4, the lid section 12 is removed from the bottle 30 together with the cap 20 while only the lid section 12 of the inner stopper 10 is separated from the main body 11 and remains entering the receiving section 22 of the cap 20. Since the protrusion section 23 is formed in the cap 20, the lid section 20 thereafter remains entering in the receiving section 22 of the cap 20.

In the case of the comparative example illustrated in these FIG. 1 to FIG. 4, it is possible to open the inner stopper 10 by rotating temporarily the cap 20 in the direction of closing when opening the cap 20 initially, and such an action to open an inner stopper after opening a cap is not required, and thus, the usability is much improved.

However, in the case of this comparative example, it is required that the inner stopper 10 and the cap 20 are separately managed, and a process of capping the inner stopper 10 to the bottle 30 and a process of closing with the cap are required to be provided separately. Further, in a series of the processes of filling the bottle 30 with a content and sealing, such a control that the cap 20 is closed until the protrusion section 23 is positioned immediately above the lid section 121 as illustrated in FIG. 1 is required.

Based on the above explanations of the comparative example, embodiments according to the present invention will be explained next.

Figure 5:
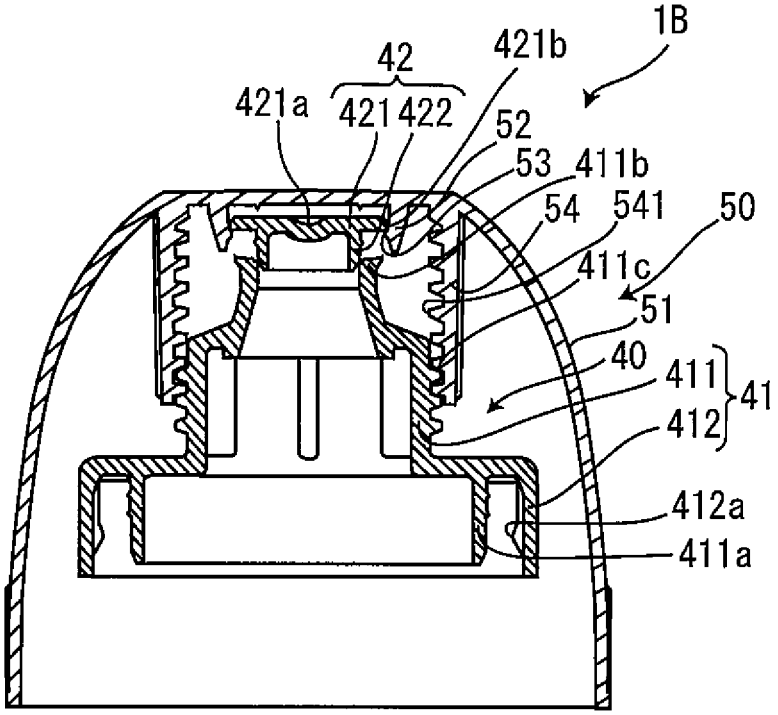
FIG. 5 is a vertical sectional view of a cap assembly of a first embodiment according to the present invention.

FIG. 5 is a vertical sectional view of a cap assembly of a first embodiment according to the present invention.

A cap assembly 1B of the first embodiment illustrated in this FIG. 1 includes an inner stopper 40 and a cap 50.

Figure 14:
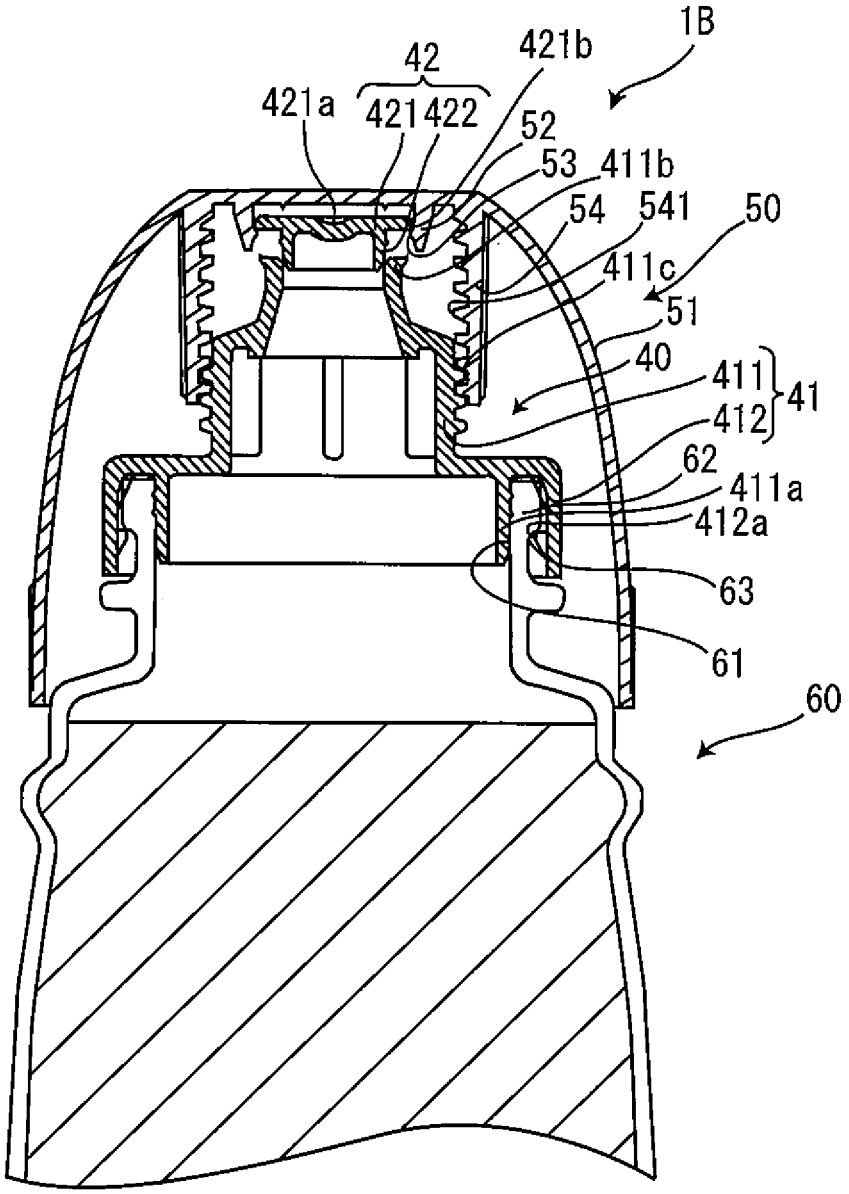
FIG. 14 is an explanatory view of a scene in which the cap assembly of the first embodiment is capped to a bottle.

The inner stopper 40 is a component which is put over a mouth 61 of a bottle 60 to close the mouth 61 (see FIG. 14). In addition, the cap 50 is a component which is put over the mouth 61 of the bottle 60 upon the inner stopper 40 such that the cap 50 covers the inner stopper 40.

The inner stopper 40 includes a main body 41 and a lid body 42.

The main body 41 includes a hollow section 411 and a holding section 412. Of them, the hollow section 411 has a hollow shape which has an upper opening and a lower opening and communicates with the mouth 61 of the bottle 60, and at the time of capping, a lower end section 411*a* thereof is inserted to the mouth 61 of the bottle 60 (see FIG. 14).

In addition, a male screw thread 411*c* which circles helically on an outer circumference surface of the hollow section 411 and is screwed to a female screw thread 541 of the cap 50 is formed on the outer circumference surface in the hollow section 411.

In addition, the holding section 412 included in the main body 41 plays a role of receiving an insertion of an upper end section 62 of the bottle 60 to hold the upper end section 62 of the bottle 60 in cooperation with the lower end section 411*a* of the hollow section 411 which lower end section 411*a* is inserted to the mouth 61 of the bottle 60. The holding section 412 has a configuration in which a rib 412*a* is formed in the holding section 412, and the rib 412*a* enters a depressed section 63 (see FIG. 14) of the bottle 60 so that the holding section 412 firmly holds the upper end section 62 of the bottle 60 and is not removed from the mouth 61 of the bottle 60.

In addition, the lid body 42 included in the inner stopper 40 includes a lid section 421 and a junction section 422. Of them, the lid section 421 is a portion which spreads in a plate shape above the hollow section 411 such that the lid section 421 covers the hollow section 411. In addition, the junction section 422 is junctioned circumferentially to an upper end edge 411*b* of the hollow section 411, and closes an opening on an upper end of the hollow section 411 together with the lid section 421. The main body 41 and the lid body 42 which are included in the hollow section 40 are integrally formed as a single component, and however, the junction section 422 is considerably easily broken when the lid section 421 is pressed from above. When the junction section 422 is broken, the lid body 42 becomes a part separate from the main body 41.

In order to secure a safety margin ratio as large as possible such that the junction section 422 is not broken inadvertently, it is devised such that a recess 421*a* is formed on an upper surface of the lid section 421 so that the lid section 421 is made to be away as much as possible from an upper surface of the cap 50, and thus, even if a force is applied to the upper surface of the cap 50 and the upper surface is depressed, the force is not applied to the lid section 421.

Figure 6:
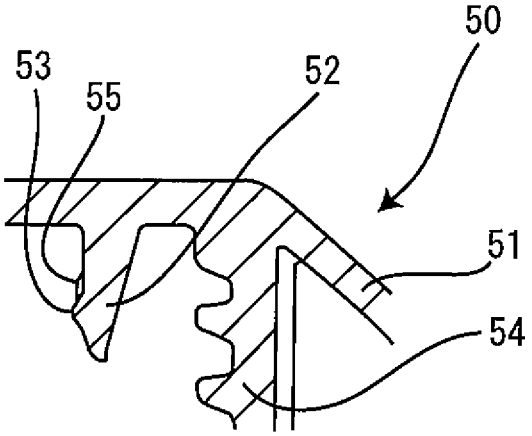
FIG. 6 is a partially enlarged sectional view of a cap included in the cap assembly of the first embodiment illustrated in FIG. 5.

The cap 50 includes a shell section 51, a receiving section 52, a protrusion section 53, a screwing section 54 which are illustrated in FIG. 5, and further, hooks 55 (see FIG. 6).

The shell section 51 is a portion which is formed to be hollow while opening downward, and is put over the mouth 61 of the bottle 60 (see FIG. 14) upon the inner stopper 40 while covering the inner stopper 40.

In addition, the receiving section 52 is a portion which protrudes in a cylindrical shape and downward from an inner side upper surface of the shell section 51, has a lower opening section, and receives the lid section 421 of the main body 41 in an inside thereof to surround an edge 421*b* of the lid section 421.

Further, the protrusion section 53 is a portion which has a rib shape protruding inward from an inner circumference surface of the receiving section 52. This protrusion section 53 protrudes up to a position in which the protrusion section 53 interferes with the edge 421*b* of the lid section 421 when the lid section 421 passes up from below relatively to the cap 50.

In addition, the screwing section 54 has a shape which protrudes in a cylindrical shape and downward from an inner side upper surface of the shell section 51 and opens downward. The female screw thread 541 which is screwed to the male screw thread 411*c* formed on the outer circumference surface of the hollow section 411 of the inner stopper 40 is formed on an inner circumference surface of the screwing section 54. In other words, in the above-described comparative example, the cap 20 is opened or closed with respect to the bottle 30, and in contrast, in the case of the cap assembly 1B of the first embodiment, it is configured such that the cap 50 is opened or closed with respect to the inner stopper 40 in terms of directly.

FIG. 6 is a partially enlarged sectional view of a cap included in the cap assembly 1B of the first embodiment illustrated in FIG. 5.

Figure 7:
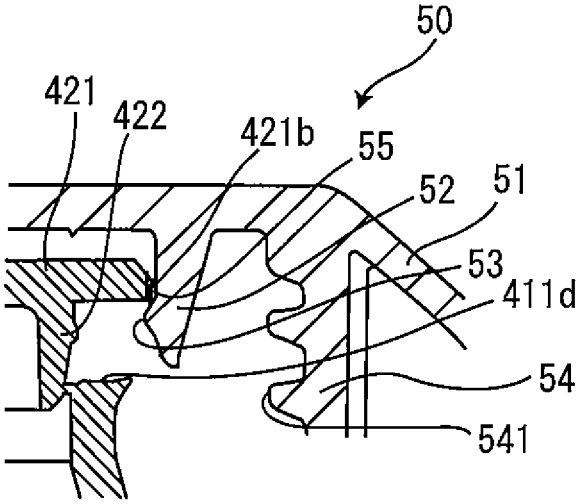
FIG. 7 is a partially enlarged sectional view illustrating a portion of the cap assembly of the first embodiment illustrated in FIG. 5 in a state in which a lid section of an inner stopper is received in a receiving section of the cap.

In addition, FIG. 7 is a partially enlarged view illustrating a portion of the cap assembly 1B of the first embodiment illustrated in FIG. 5 in a state in which the lid section 42 of the inner stopper 40 is received in the receiving section 52 of the cap 50.

In the case of the cap assembly 1B of the first embodiment, as illustrated in FIG. 5 and FIG. 7, the lid section 421 of the inner stopper 40 enters a space upper than the protrusion section 53 in the receiving section 52 of the cap 50. However, there is formed a space between an inner surface of an upper section of the shell section 51 and the lid section 422 such that the space is opened to an extent in which even if a force is applied to the shell section 51 from above and the shell section 51 is depressed slightly, the force is not applied to the lid section 421.

In addition, as illustrated in FIG. 6, the hooks 55 protruding inward are formed in a portion immediately above the protrusion section 53 and inside the receiving section 50 of the cap 50. The hooks 55 are formed at plural locations with spaces with respect to a circumferential direction, respectively.

Figure 8:
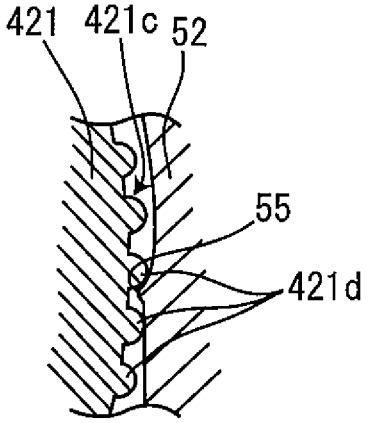
FIG. 8 is a partially enlarged sectional view illustrating a portion of an edge of the lid section sectioned in a section in which the lid section is sectioned horizontally in a state in which the lid section of the inner stopper enters the receiving section of the cap.

FIG. 8 is a partially enlarged sectional view illustrating a portion of an edge 421*b* of the lid section 421 in a section in which the lid section 421 is sectioned horizontally in a state in which the lid section of the inner stopper enters the receiving section of the cap.

As illustrated in this FIG. 8, there are included rotation preventing protrusions 421*d* which are formed circumferentially in a circumferential direction on a circumference surface 421*c* of the lid section 421 of the inner stopper 40 in large numbers. The rotation preventing protrusions 421*d* engage with the hooks 55 to prevent a positional relation between the cap 50 and the inner stopper 40 from being deviated from a predetermined relation.

FIG. 9 to FIG. 12 are explanatory views of an assembling method of assembling the cap to the inner stopper in the cap assembly of the first embodiment which have been explained with reference to FIG. 5 to FIG. 8.

Figure 9:
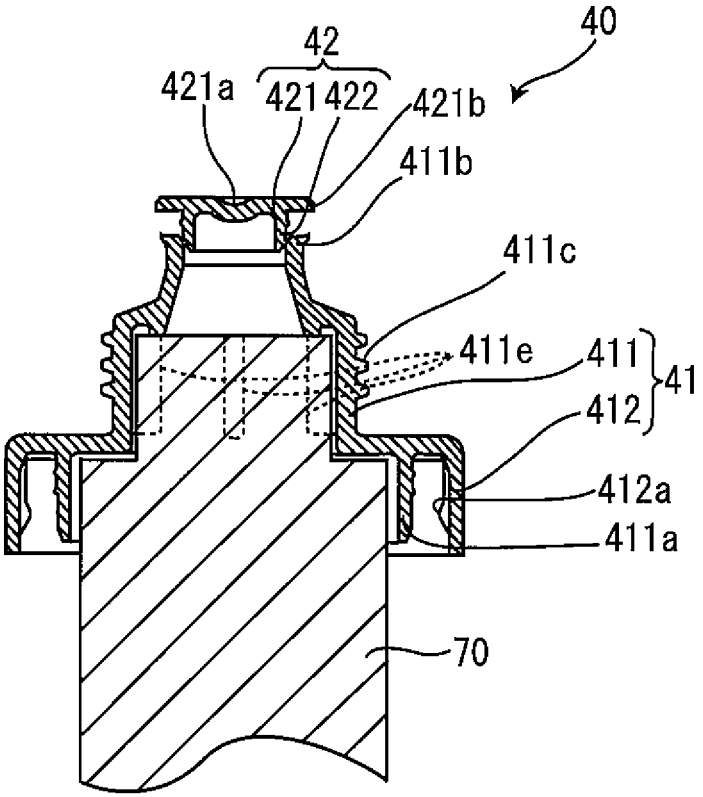
FIG. 9 is an explanatory view of an assembling method of assembling the cap to the inner stopper in the cap assembly of the first embodiment explained with reference to FIG. 5 to FIG. 8.

At first, as illustrated in FIG. 9, the inner stopper 40 is placed on a jig 70 which agrees with a shape of the inner stopper 40. Ribs 411*e* are formed on an inner circumference surface of the hollow section 411 in the inner stopper 40, and the ribs 411*e* are fitted in depressions (not illustrated in the drawings) of the jig 70 to prevent rotation.

Figure 10:
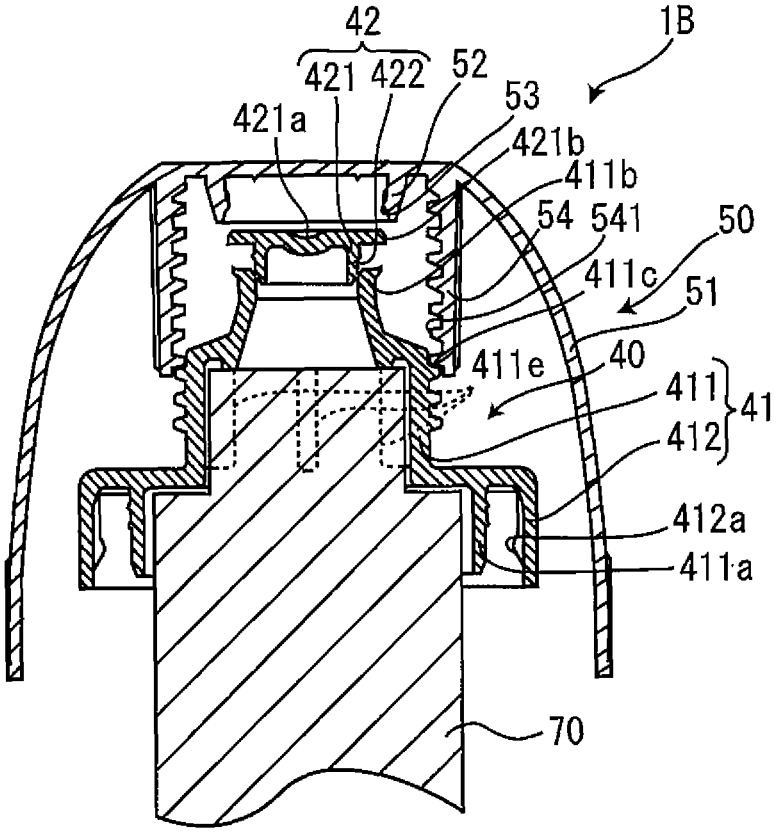
FIG. 10 is an explanatory view of the assembling method of assembling the cap to the inner stopper in the cap assembly of the first embodiment explained with reference to FIG. 5 to FIG. 8.
Figure 11:
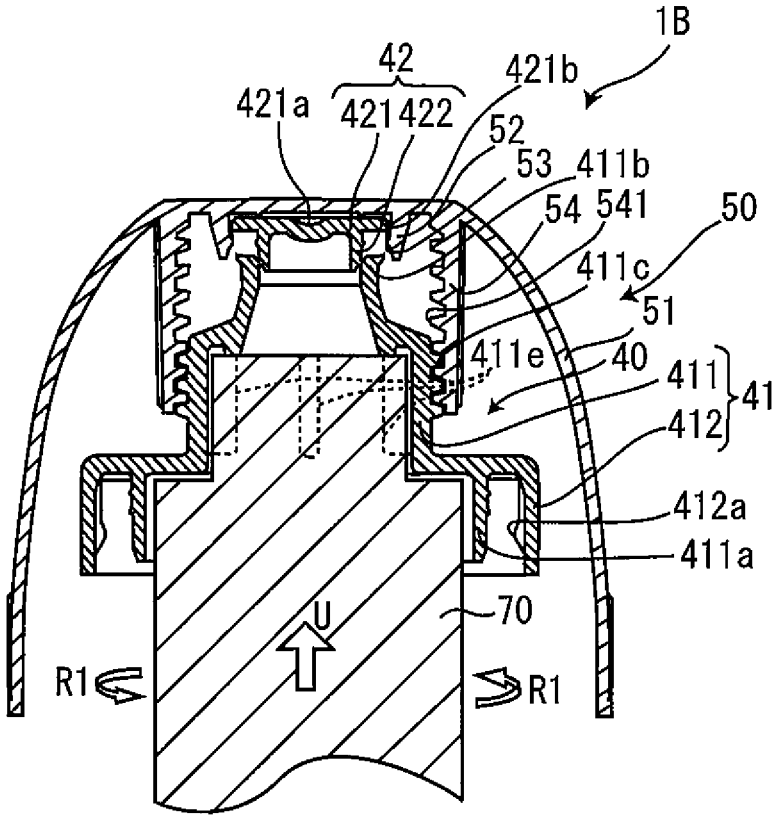
FIG. 11 is an explanatory view of the assembling method of assembling the cap to the inner stopper in the cap assembly of the first embodiment explained with reference to FIG. 5 to FIG. 8.

Next, as illustrated in FIG. 10, the cap 50 is put on, and with the cap 50 being fixed, the jig 70 is moved up in a direction of arrow U while being rotated in a direction of arrow R1 as illustrated in FIG. 11. Since the inner stopper 40 is prevented from rotating with respect to the jig 70, the inner stopper 40 rotates together with the jig 70, and the male screw thread 411*c* of the inner stopper 40 is screwed to the female screw thread 541 of the screwing section 54 of the cap 50. Then, the edge 421*b* of the lid section 421 of the inner stopper 40 interferes with the protrusion 53 (see FIG. 6) formed on the inner circumference surface of the receiving section 52 of the cap 50, and thus, the receiving section 52 is expanded by the lid section 421 of the inner stopper 40, and when the lid section 421 goes beyond the protrusion section 53 and comes to a side of the upper surface of the shell section 51, the receiving section 52 returns to an original shape. With this, the protrusion section 53 plays a role in which the protrusion section 53 is positioned below the lid section 421, and as described later, even after the junction section 422 is broken, the protrusion section 53 supports the lid section 421 to keep the lid section 421 in an inside of the receiving section 52.

When the lid section 421 rides on the protrusion section 53, the receiving section 52 is expanded and the torque to rotate the jig 70 increases, and when the lid section 421 goes beyond the protrusion section 53, the torque quickly decreases. Accordingly, by monitoring the torque, it is possible to detect that the lid section 421 has gone beyond the protrusion section 53. Or, instead of monitoring the torque, by using a rotation angle in the direction of arrow R1 or a movement amount in the direction of arrow U of the jig 70, it may be detected that the lid section 421 has gone beyond the protrusion section 53.

Here, only by rotating the jig 70 and the inner stopper 40 in the direction of arrow R1 illustrated in FIG. 11, it is difficult to hold the lid section 421 at a position beyond the protrusion section 53 and immediately above the protrusion section 53, and thus, the lid section 421 results in going upward excessively in the receiving section 52.

Figure 12:
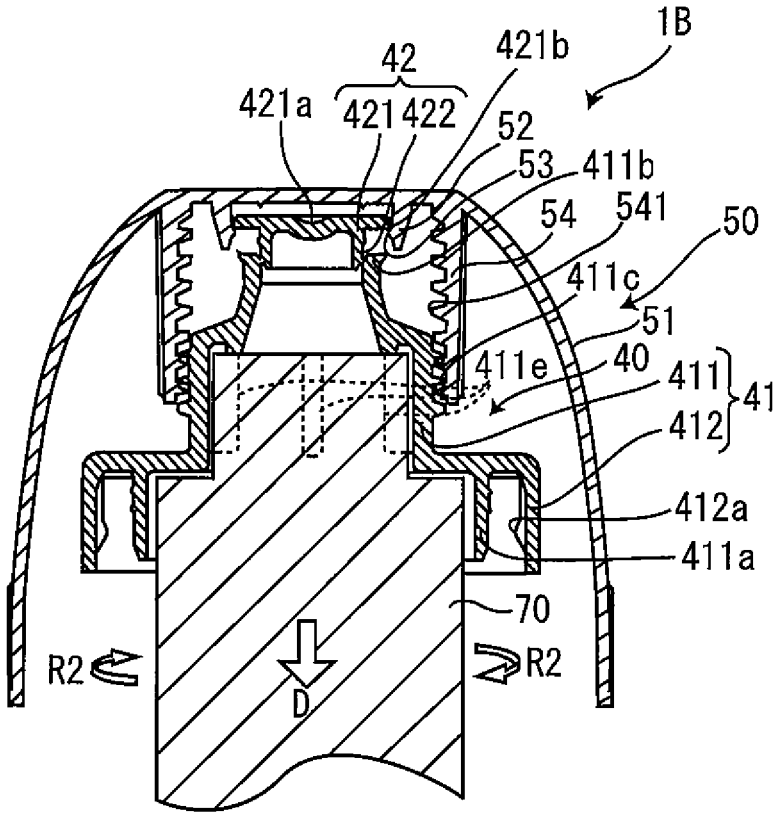
FIG. 12 is an explanatory view of the assembling method of assembling the cap to the inner stopper in the cap assembly of the first embodiment explained with reference to FIG. 5 to FIG. 8.

Then next, as illustrated in FIG. 12, the jig 70 is moved downward in a direction of arrow D while the jig 70 is now inversely rotated in a direction of arrow R2, so that, the lid section 421 is positioned immediately above the protrusion section 53. Since the torque to rotate the jig 70 begins to increase when the lid section 421 abuts against the protrusion section 53, it is possible to detect that the lid section 421 comes down up to immediately above the protrusion section 53 by monitoring the torque. Or, it may be detected that the lid section 421 reaches immediately above the protrusion section 53 by using a rotation angle in the direction of arrow R2, an amount of moving down in the direction of arrow D or the like.

In the state in which the lid section 421 is immediately above the protrusion section 53, as illustrated in FIG. 8, the rotation preventing protrusions 421*d* engage with the hooks 55, and thus, the inner stopper 40 and the cap 50 are not rotated inadvertently by such a degree as a vibration at the time of transportation, and thus, the positional relation thereof is maintained.

Incidentally, as illustrated in FIG. 6 and FIG. 7, the hooks 55 for rotation prevention are provided only in a portion immediately above the protrusion section 53, and not provided in a portion further above in the receiving section 52. This is because, when the cap 50 is closed again, after delivered to a consumer and the cap 50 is opened together with the lid body 42 of the inner stopper 40, if the rotation preventing protrusions 421*d* remain engaging with the hooks 55, closing the cap 50 results in becoming heavy, and thus, when the cap 50 is closed again, the lid section 421 moves to an upper area where the hooks 55 are not provided, and thus, it is possible to close the cap 50 with a small force.

The example in which the jig 70 and the inner stopper 40 are rotated and moved vertically has been explained in here, and however, a jig (not illustrated in the drawings) to hold the cap 50 may be rotated or moved vertically with the inner stopper 40 being fixed.

Next, a scene in which the cap assembly is capped to a bottle will be explained.

Figure 13:
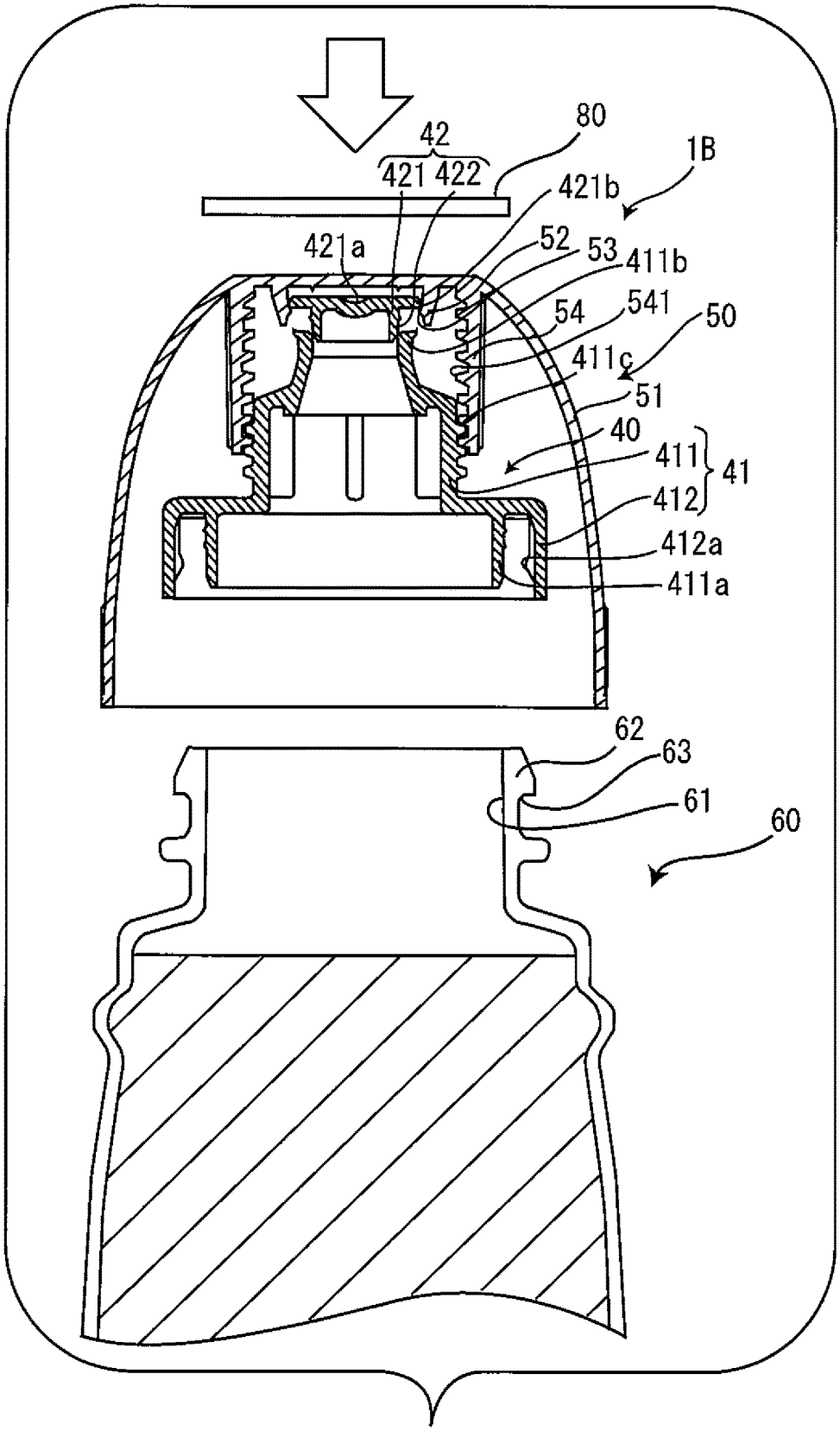
FIG. 13 is an explanatory view of a scene in which the cap assembly of the first embodiment is capped to a bottle.

FIG. 13 and FIG. 14 are explanatory views of a scene in which the cap assembly of the first embodiment is capped to a bottle.

The bottle 60 is filled with a content, and, as illustrated in FIG. 13, the cap assembly 1B is pressed down, for example, with a flat plate 80 being put thereon, while the state in which the inner stopper 40 and the cap 50 are coupled with each other is maintained. Then, as illustrated in FIG. 14, the upper end section 62 of the bottle 60 enters between the lower end section 411*a* of the hollow section 41 of the inner stopper 40 and the holding section 412, the rib 412*a* formed in the holding section 412 enters the depressed section 63 of the bottle 60, and thus, the inner stopper 40 is firmly fixed to the mouth 61 of the bottle 60.

After the cap assembly 1B is capped to the bottle 60, shrink wrap packaging is performed.

Figure 15:
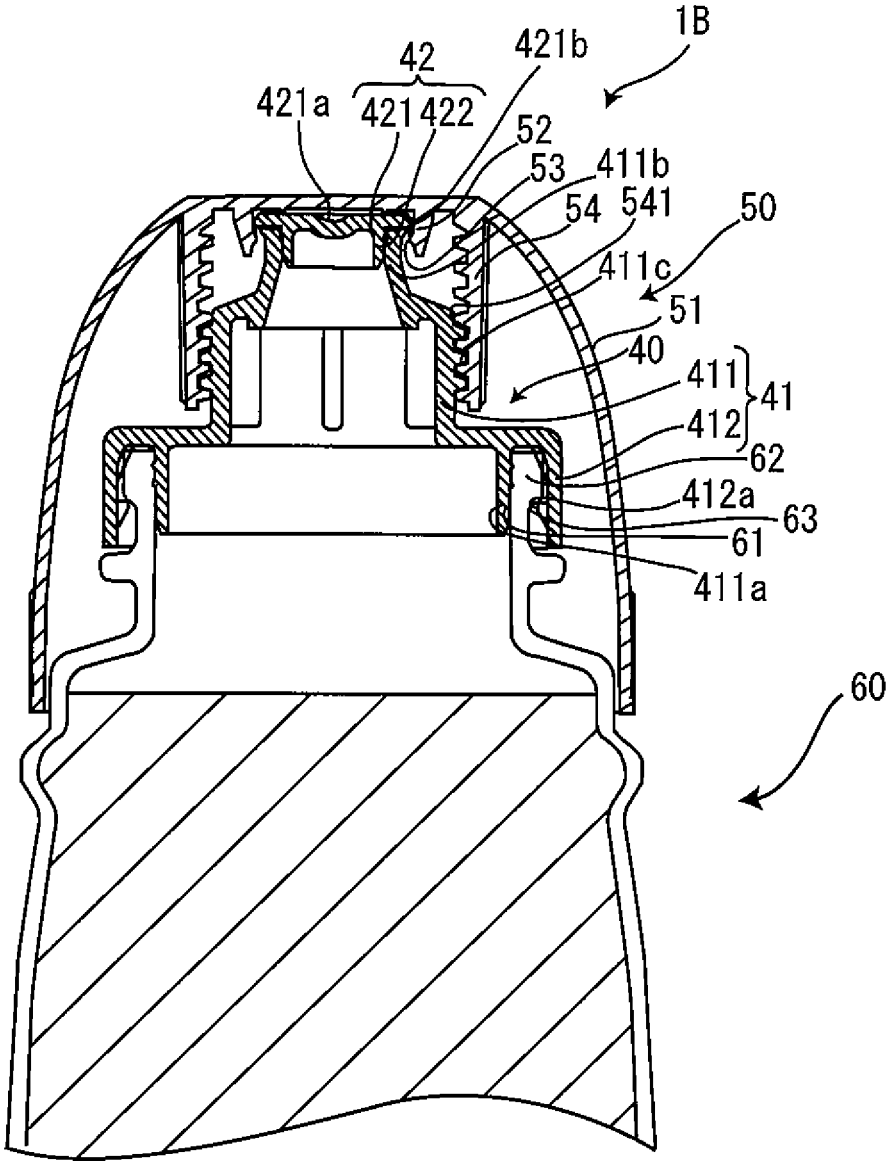
FIG. 15 is an explanatory view of a scene in which the cap is opened initially.
Figure 16:
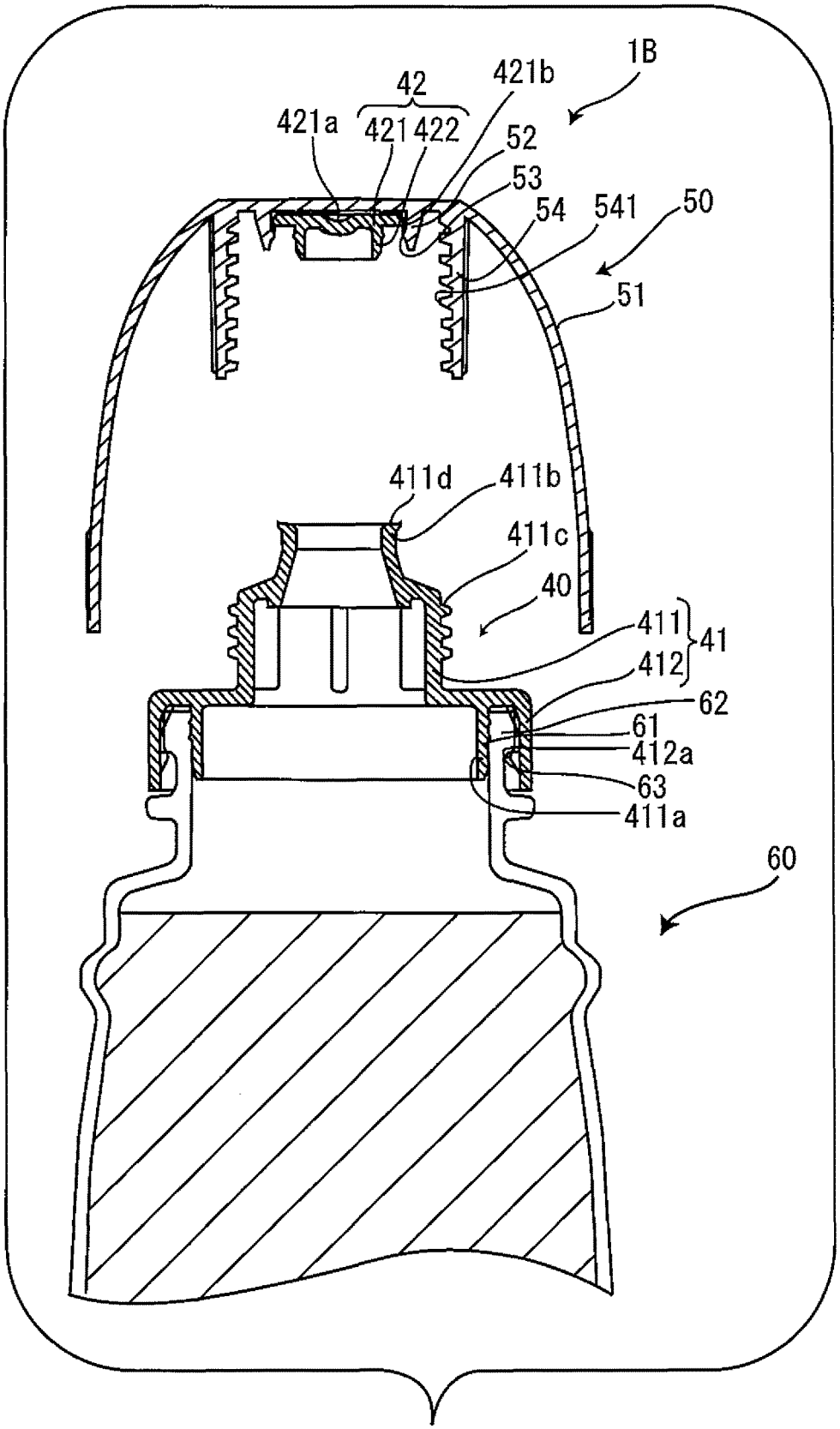
FIG. 16 is an explanatory view of a scene in which the cap is opened initially.

FIG. 15 and FIG. 16 are explanatory views of a scene in which the cap is opened initially.

A product is delivered to a consumer, in the state illustrated in FIG. 14.

After the consumer opens the shrink wrap, the consumer temporarily rotates the cap 50 in the direction of closing. Then, as illustrated in FIG. 15, the cap 50 presses down the lid section 42 of the inner stopper 40, and with this, the junction section 421*b* is broken. Then, when the cap 50 is rotated in the direction of opening, as illustrated in FIG. 16, the cap 50 is removed while the lid section 421 of the inner stopper 40 is kept in the receiving section 52 of the cap 50. At this moment, the mouth of he inner stopper 40 is in a state of opened already.

Incidentally, the upper end surface 411*d* on an edge surrounding the upper opening of the inner stopper 40 which upper end surface 411*d* is oriented upward is formed to be a surface which has a gradient rising outward, as illustrated in FIG. 7. The upper end surface 411*d* having the gradient rising outward has an effect that when the bottle 60 is inclined to pour a content thereof and then is stood up, the content is cut well, and thus, it is prevented that the content drips inadvertently.

Next, a cap assembly of a second embodiment according to the present invention will be explained. As to the cap assembly of the second embodiment, elements respectively corresponding to those of the cap assembly 1B according to the first embodiment which have been explained above will be illustrated while denoted with reference signs same as those denoted in the drawings of the above-described cap assembly 1B according to the first embodiment even if there are differences in shape and the like, and only differences will be explained.

Figure 17:
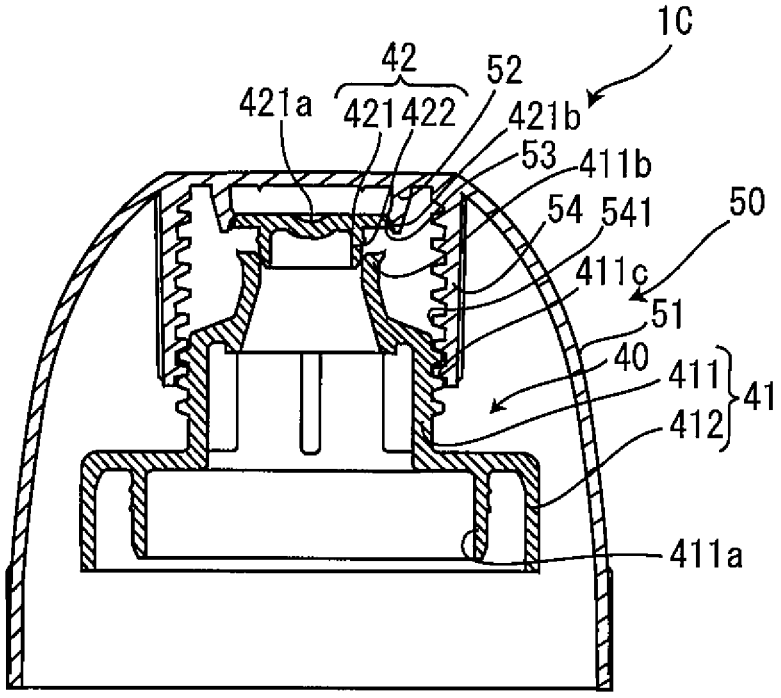
FIG. 17 is a vertical sectional view of a cap assembly of a second embodiment according to the present invention.

FIG. 17 is a vertical sectional view of a cap assembly of the second embodiment according to the present invention.

In a case of a cap assembly 1C, a cap 50 is coupled with an inner stopper 40 such that a lid section 421 of the inner stopper 40 is positioned immediately below a protrusion section 53 of the cap 50.

Figure 18:
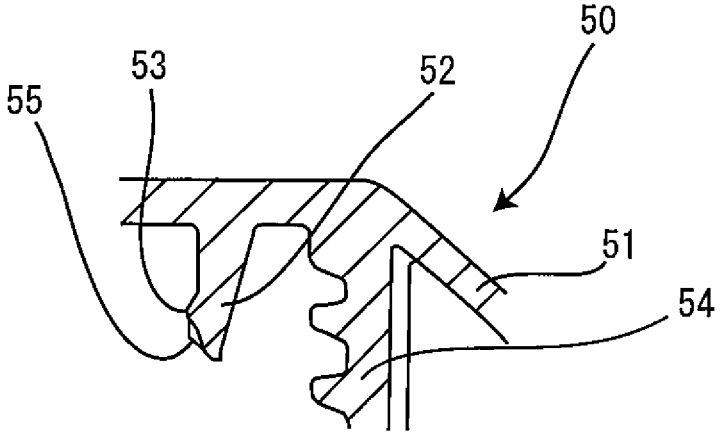
FIG. 18 is a partially enlarged sectional view of a cap included in the cap assembly of the second embodiment illustrated in FIG. 17.

FIG. 18 is a partially enlarged sectional view of a cap included in the cap assembly 1C of the second embodiment illustrated in FIG. 17. FIG. 18 is a view corresponding to FIG. 6 in the above-described first embodiment.

In the case of the second embodiment, the lid section 421 of the inner stopper 40 is positioned immediately below the protrusion section 53 of the cap 50, and in relation to this, hooks 55 are formed immediately below the protrusion section 53.

Figure 19:
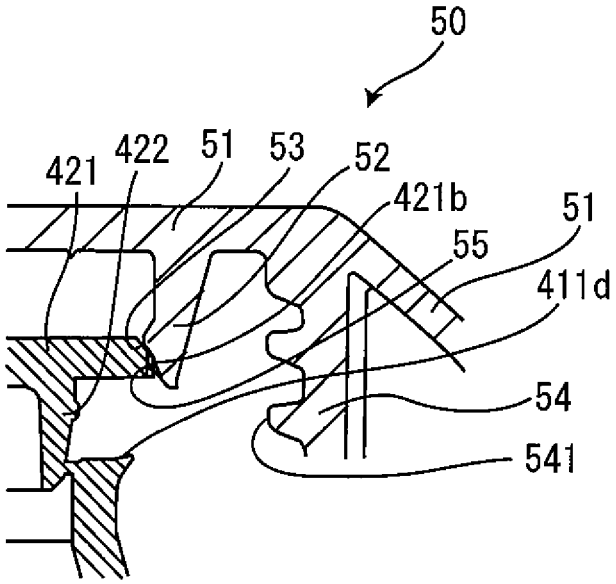
FIG. 19 is a partially enlarged sectional view illustrating a portion of the cap assembly of the second embodiment illustrated in FIG. 17 in a state in which a lid section of an inner stopper is received in a receiving section of the cap.

FIG. 19 is a partially enlarged sectional view illustrating a portion of the cap assembly 1C of the second embodiment illustrated in FIG. 17 in a state in which the lid section 42 of the inner stopper 40 is received in a receiving section 52 of the cap 50. FIG. 19 is a view corresponding to FIG. 7 in the above-described first embodiment.

As explained with reference to FIG. 17, the lid section 421 of the inner stopper 40 is received in the receiving section 52 of the cap 50, and is stopped immediately below the protrusion section 53 in which the hooks 55 are formed.

In other words, compared to the above-described first embodiment, the second embodiment is different in a position in which the rotation of the cap 50 with respect to the inner stopper 40 is stopped. In order to assemble the inner stopper 40 and the cap 50 as described, it may be stopped based on that the lid section 42 of the inner stopper 40 abuts against the protrusion section 53 of the cap from below and the torque begins to increase.

Figure 20:
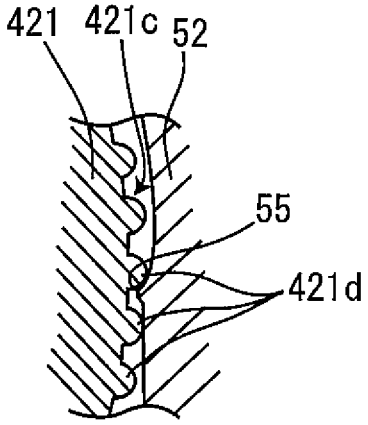
FIG. 20 is a partially enlarged sectional view illustrating a portion of a circumference edge of the lid section in a section in which the lid section is horizontally sectioned in a state in which the lid section of the inner stopper enters the receiving section of the cap.

FIG. 20 is a partially enlarged sectional view illustrating a portion of an edge of the lid section in a section in which the lid section is horizontally sectioned in a state in which the lid section of the inner stopper enters the receiving section of the cap. This FIG. 20 is a view corresponding to FIG. 8 in the above-described first embodiment.

Also in the second embodiment, similarly to the above-described first embodiment, as illustrated in this FIG. 20, rotation preventing protrusions 421*d* which are formed in large numbers circumferentially in a circumferential direction on a circumference surface 421*c* of the lid section 421 of the inner stopper 40. The rotation preventing protrusions 421*d* engage with the hooks 55, and prevent a positional relation between the cap 50 and the inner stopper 40 from being deviated from a predetermined relation.

The cap assembly 1C of the second embodiment is handled in a state illustrated in FIG. 17 and capped to the bottle 60. A scene of capping to a bottle is similar to that of the case of the first embodiment described above, and illustrations and explanations will be omitted.

Next, as to the second embodiment, a scene in which the cap is initially opened will be explained.

Figure 21:
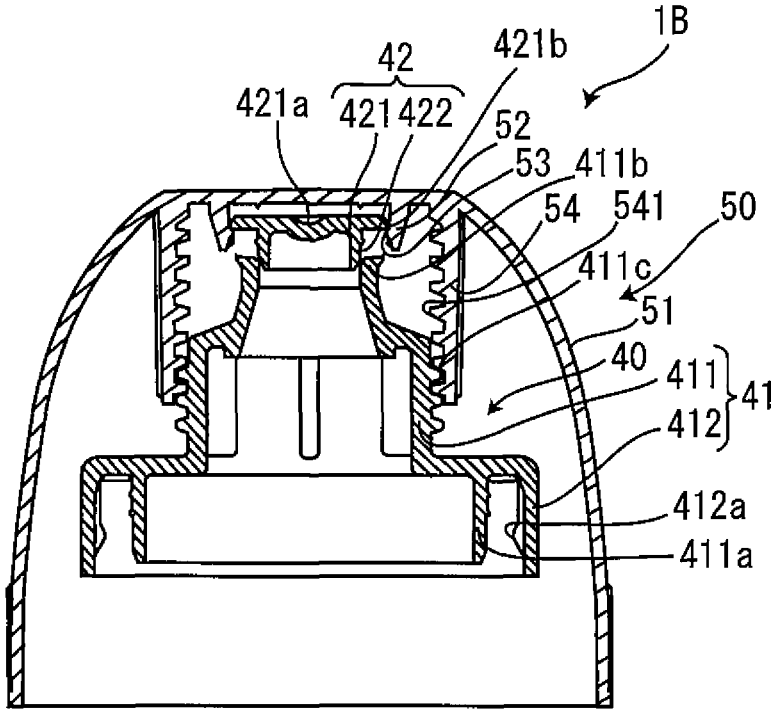
FIG. 21 is an exemplary view of a scene in which the cap is opened initially in the second embodiment.
Figure 22:
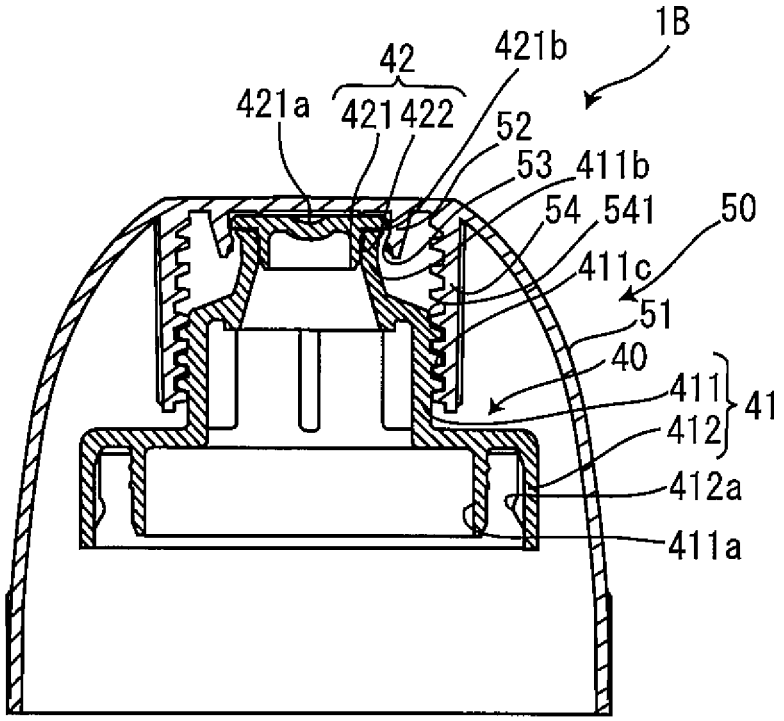
FIG. 22 is an exemplary view of a scene in which the cap is opened initially in the second embodiment.
Figure 23:
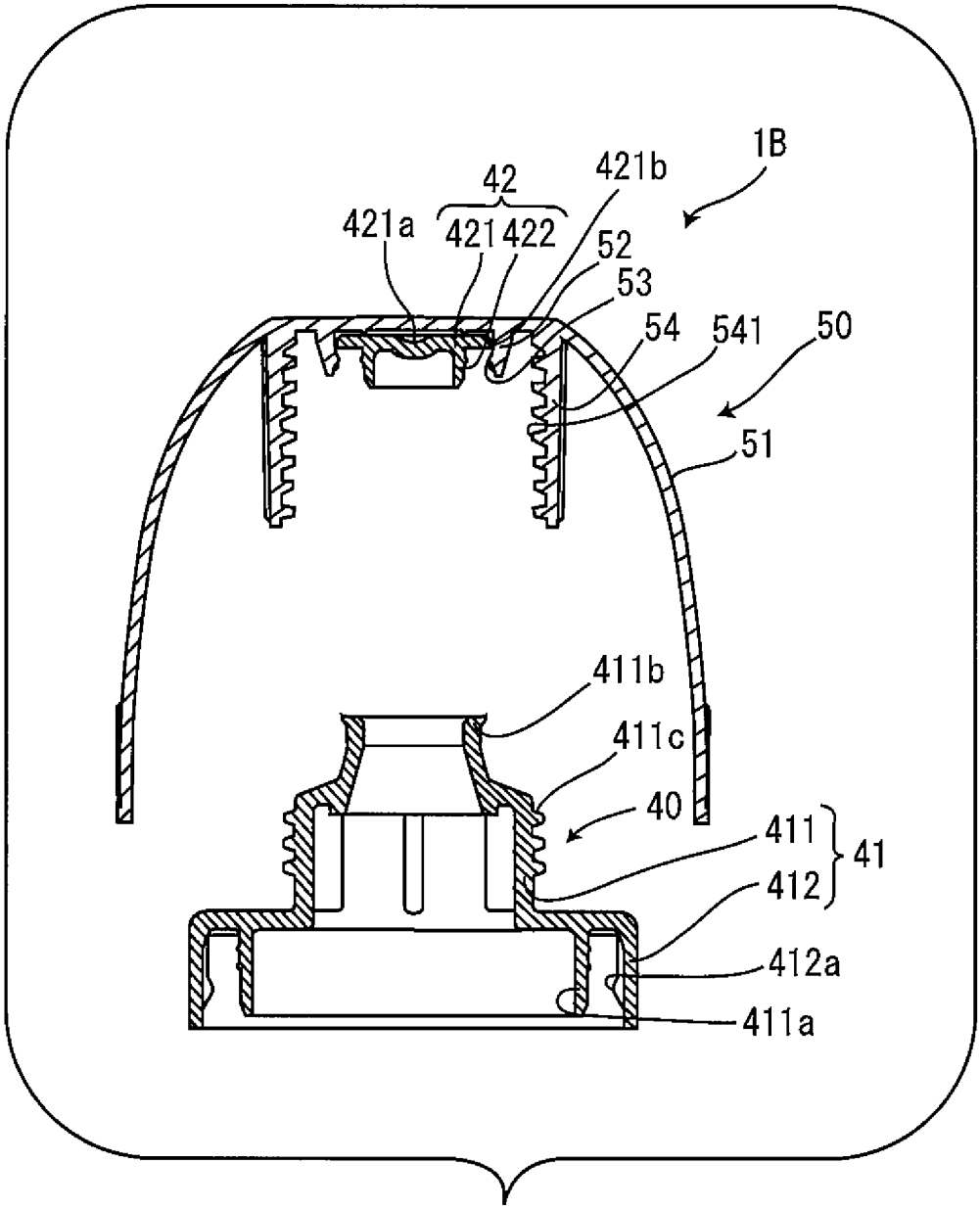
FIG. 23 is an exemplary view of a scene in which the cap is opened initially in the second embodiment.

FIG. 21 to FIG. 23 are exemplary views of a scene in which the cap in the second embodiment is opened initially.

The cap assembly after capped to the bottle and being in the state illustrated in FIG. 17 is delivered to a consumer.

Then, after removing the shrink wrap, the cap is temporarily rotated in the direction of closing. Thus, as illustrated in FIG. 21, at this point, the lid section 421 goes beyond the protrusion section 53 and further enters a deep side of the receiving section 52. When the cap is further rotated in the direction of closing, the lid section 421 of the inner stopper 40 is pressed by the cap 50 and the junction section 52 is broken, as illustrated in FIG. 22. And next, the cap is now rotated in the direction of opening, the cap 50 and the lid section 42 of the inner stopper 40 are removed integrally, and a state in which the inner stopper is opened occurs.

As explained, in the present invention, the stop position of the lid section 421 may be either above or below the protrusion section 53.

REFERENCE SIGNS LIST

1A, 1B, 1C Cap assembly
10, 40 Inner stopper
11, 41 Main body
12, 42 Lid body
20, 50 Cap
21, 51 Shell section
22, 52 Receiving section
23, 53 Protrusion section
30, 60 Bottle
31, 61 Mouth
32, 62 Upper end section
34, 411*c* Male screw thread
112*a*, 412*a*, 411*e* Rib
54 Screwing section
55 Hook
63 Depressed section
70 Jig
80 Plate
111, 411 Hollow section
112, 412 Holding section
111*a*, 411*a* Lower end section
111*b*, 411*b* Upper end section
121, 421 Lid section
121*b*, 421*b* Edge
122, 422 Junction section
121*a*, 421*a* Recess
411*d* Upper end surface
421*b* Junction section
421*c* Circumference surface
421*d* Rotation preventing protrusion
541 Female screw thread

What is claimed is:

1. A cap assembly comprising:

an inner stopper that is put over a mouth of a bottle to close the mouth; and a cap that is put over the mouth of the bottle such that the cap covers the inner stopper, wherein the inner stopper comprises:

a main body that includes a hollow section which has a hollow shape having an upper opening and a lower opening and communicating with the mouth of the bottle, and whose lower end section is inserted to the mouth of the bottle, a holding section which holds an upper end section of the bottle in cooperation with the lower end section of the hollow section after the insertion has been executed, and a first screw thread for screwing to the cap; and a lid body that includes a lid section which spreads above the hollow section such that the lid section covers that hollow section, a junction section which is circumferentially junctioned to an upper end edge of the hollow section and closes the upper opening on an upper end of the hollow section together with the lid section, and that is a component integral with the main body, closes the mouth of the bottle together with the main body, and receives pressing from above to have the junction section broken so as to become a part separate from the main body, the cap comprises:

a shell section that is formed to be hollow while opening downward and is put over the mouth of the bottle while covering the inner stopper;

a receiving section that protrudes in a cylindrical shape and downward from an inner side upper surface of the shell section, has a lower opening section, and receives the lid section in an inside to surround an edge of the lid section;

a protrusion section that protrudes inward from an inner circumference surface of the receiving section, interferes with the edge of the lid section to cause the lid section to expand the receiving section when the lid section goes up from below relatively to the cap, causes the receiving section to return to an original shape so as to be positioned below the lid section when the lid section comes to a side of an upper surface of the shell section, and supports the lid section after the junction section is broken; and a second screw thread that is screwed to the first screw thread, and the first screw thread and the second screw thread are screwed to each other, and the cap is coupled with the inner stopper in a state in which the cap receives the lid section in the receiving section, wherein the receiving section includes a hook which protrudes inward on a side above the protrusion section on the inner circumference surface of the receiving section and is for preventing a rotation of the cap, the lid section includes plural rotation preventing protrusions which are arranged in a circumferential direction on a circumference surface of the lid section which circumference surface facing the inner circumference surface of the receiving section and engage with the hook, and the cap and the inner stopper are coupled with each other in a state in which the first screw thread and the second screw thread are screwed to each other, the lid section is received in the receiving section, the protrusion section is positioned below the lid section, and the rotation preventing protrusions engage with the hook.

2. The cap assembly according to claim 1, wherein the first screw thread is a screw thread which circles helically on an outer circumference surface of the hollow section, and the cap includes a screwing section which protrudes in a cylindrical shape and downward from the inner side upper surface of the shell section and opens downward, and on whose inner circumference surface a screw thread to be screwed to the male screw thread is formed, and the second screw thread is formed on an inner circumference surface of the screwing section.

3. A cap assembly comprising:

an inner stopper that is put over a mouth of a bottle to close the mouth; and a cap that is put over the mouth of the bottle such that the cap covers the inner stopper, wherein the inner stopper comprises:

a main body that includes a hollow section which has a hollow shape having an upper opening and a lower opening and communicating with the mouth of the bottle, and whose lower end section is inserted to the mouth of the bottle, a holding section which holds an upper end section of the bottle in cooperation with the lower end section of the hollow section after the insertion has been executed, and a first screw thread for screwing to the cap; and a lid body that includes a lid section which spreads above the hollow section such that the lid section covers that hollow section, a junction section which is circumferentially junctioned to an upper end edge of the hollow section and closes the upper opening on an upper end of the hollow section together with the lid section, and that is a component integral with the main body, closes the mouth of the bottle together with the main body, and receives pressing from above to have the junction section broken so as to become a part separate from the main body, the cap comprises:

a shell section that is formed to be hollow while opening downward and is put over the mouth of the bottle while covering the inner stopper;

a receiving section that protrudes in a cylindrical shape and downward from an inner side upper surface of the shell section, has a lower opening section, and receives the lid section in an inside to surround an edge of the lid section;

a protrusion section that protrudes inward from an inner circumference surface of the receiving section, interferes with the edge of the lid section to cause the lid section to expand the receiving section when the lid section goes up from below relatively to the cap, causes the receiving section to return to an original shape so as to be positioned below the lid section when the lid section comes to a side of an upper surface of the shell section, and supports the lid section after the junction section is broken; and a second screw thread that is screwed to the first screw thread, and the first screw thread and the second screw thread are screwed to each other, and the cap is coupled with the inner stopper in a state in which the cap receives the lid section in the receiving section, wherein the receiving section includes a hook which protrudes inward on a side below the protrusion section on the inner circumference surface of the receiving section and is for preventing rotating of the cap, the lid section includes plural rotation preventing protrusions which are arranged in a circumferential direction on a circumference surface of the lid section which circumference surface facing the inner circumference surface of the receiving section and engage with the hook, and the cap and the inner stopper are coupled with each other in a state in which the first screw thread and the second screw thread are screwed to each other, the lid section is received in the receiving section, the protrusion section is positioned above the lid section, and the rotation preventing protrusions engage with the hook.

4. The cap assembly according to claim 3, wherein the first screw thread is a screw thread which circles helically on an outer circumference surface of the hollow section, and the cap includes a screwing section which protrudes in a cylindrical shape and downward from the inner side upper surface of the shell section and opens downward, and on whose inner circumference surface a screw thread to be screwed to the male screw thread is formed, and the second screw thread is formed on an inner circumference surface of the screwing section.

* * * * *